US010633936B2

(12) United States Patent
Aslaksen et al.

(10) Patent No.: US 10,633,936 B2
(45) Date of Patent: Apr. 28, 2020

(54) HOISTING SYSTEM

(71) Applicant: MHWIRTH AS, Kristiansand (NO)

(72) Inventors: Tord Aslak Aslaksen, Lillesand (NO); Eivind Gimming Stensland, Kristiansand (NO); Nicolai Nilsen, Kristiansand (NO); Per Inge Roensberg, Kristiansand (NO)

(73) Assignee: MHWIRTH AS, Kristiansand S (NO)

( * ) Notice: Subject to any disclaimer, the term of this patent is extended or adjusted under 35 U.S.C. 154(b) by 0 days.

(21) Appl. No.: 15/766,004

(22) PCT Filed: Oct. 6, 2016

(86) PCT No.: PCT/NO2016/050202
§ 371 (c)(1),
(2) Date: Apr. 5, 2018

(87) PCT Pub. No.: WO2017/061875
PCT Pub. Date: Apr. 13, 2017

(65) Prior Publication Data

US 2019/0112881 A1 Apr. 18, 2019

(30) Foreign Application Priority Data

Oct. 8, 2015 (NO) ..... 20151354
Oct. 8, 2015 (NO) ..... 20151355

(51) Int. Cl.
*E21B 19/00* (2006.01)

(52) U.S. Cl.
CPC ..... *E21B 19/008* (2013.01); *E21B 19/006* (2013.01)

(58) Field of Classification Search
CPC ..... E21B 19/006; E21B 19/008
See application file for complete search history.

(56) References Cited

U.S. PATENT DOCUMENTS 3,775,986 A * 12/1973 Daughtry ..... E21B 43/0135 166/343
6,032,929 A 3/2000 Vatne
6,595,494 B1 7/2003 Roodenburg et al.
6,871,609 B2 * 3/2005 Roodenburg ..... B63B 15/00 114/201 R
6,926,259 B1 8/2005 Roodenburg et al.
7,507,055 B2 3/2009 Smith et al.
(Continued)

FOREIGN PATENT DOCUMENTS

EP 1433922 A2 * 6/2004 ..... B66C 13/02
EP 1 850 043 A2 10/2007
(Continued)

*Primary Examiner* — Matthew R Buck
*Assistant Examiner* — Aaron L Lembo
(74) *Attorney, Agent, or Firm* — Norman B. Thot

(57) ABSTRACT

A hoisting system includes a hoisting tower, a yoke which is movable relative to the hoisting tower and which carries a tool, a first winch, a second winch, a first sheave arranged in a top section of the hoisting tower, a second sheave arranged in the top section of the hoisting tower, a first hoisting member arranged to extend from the first winch to the yoke via the first sheave, a second hoisting member arranged to extend from the second winch to the yoke via the second sheave, and at least one first releasable connector which selectively connects the second hoisting member to the yoke.

23 Claims, 5 Drawing Sheets

(56) References Cited

U.S. PATENT DOCUMENTS

| | | | | |
|---|---|---|---|---|
| 10,099,752 | B2 * | 10/2018 | Roodenburg | E21B 7/12 |
| 10,323,467 | B2 * | 6/2019 | Kannegaard | E21B 15/02 |
| 2007/0177944 | A1 | 8/2007 | Smith et al. | |
| 2007/0248418 | A1 | 10/2007 | Steenhuis et al. | |
| 2009/0133881 | A1 | 5/2009 | Roodenburg et al. | |
| 2011/0017511 | A1 * | 1/2011 | Payne | E21B 7/12 175/7 |
| 2013/0284450 | A1 * | 10/2013 | Roodenburg | E21B 15/02 166/352 |
| 2014/0021421 | A1 * | 1/2014 | Torben | B66D 1/50 254/277 |
| 2014/0246203 | A1 | 9/2014 | Pohner | |
| 2016/0137466 | A1 | 5/2016 | Eriksson et al. | |
| 2017/0030152 | A1 * | 2/2017 | Ottersland | E21B 15/00 |

FOREIGN PATENT DOCUMENTS

| | | | |
|---|---|---|---|
| NO | 301384 | B1 | 10/1997 |
| NO | 335499 | B1 | 12/2014 |
| WO | WO 01/29366 | A1 | 4/2001 |
| WO | WO 2007/145503 | A1 | 12/2007 |
| WO | WO 2014/209131 | A1 | 12/2014 |
| WO | WO 2015/034370 | A1 | 3/2015 |

* cited by examiner

HOISTING SYSTEM

CROSS REFERENCE TO PRIOR APPLICATIONS

This application is a U.S. National Phase application under 35 U.S.C. § 371 of International Application No. PCT/NO2016/050202, filed on Oct. 6, 2016 and which claims benefit to Norwegian Patent Application No. 20151354, filed on Oct. 8, 2015, and to Norwegian Patent Application No. 20151355, filed on Oct. 8, 2015. The International Application was published in English on Apr. 13, 2017 as WO 2017/061875 A2 under PCT Article 21(2).

FIELD

The present invention relates to a hoisting system, and more particularly to a hoisting system for floating vessels including but not limited to hoisting systems used for offshore oil and gas exploration and exploitation.

BACKGROUND

Known technology for hoisting or lifting systems on vessels, for example, drilling vessels, intervention vessels and service vessels used in the offshore market today, include winch-based systems (for example, so-called drawworks) with a multiple stringed block. These may be arranged in a single wire or in a multi-wire setup. An alternative solution is a cylinder lifting rig, such as the RamRig™ technology.

A conventional configuration with drawworks uses a drum which winds up a single hoisting wire with very high line speed, due to the gearing factor in the travelling- and crown block system. An example of a possible arrangement is described in NO 335499 B1. WO 2014/209131 A1 describes a further example of a winch-based hoisting system comprising a winch with a winch drum, an elongated hoisting member, and where the elongated hoisting member is accommodated in a single layer on the winch drum.

A cylinder lifting configuration may utilize cylinders pushing directly onto a yoke, on which a number of sheaves are attached. The hoisting wire is attached to an anchor at one end and to a load at the other end. The lifting speed is 2:1 between the load and the cylinder movement. A set of parallel wires can be arranged to lift a common load. An example of a possible arrangement is described in NO 301384 B1.

To comply with strict safety requirements, the hoisting wire in conventional drawworks systems needs frequent replacement, which is known as cut and slip operations. This is typically based on the number of lifting cycles and/or load cycles the wire is exposed to. Such replacement of lifting wire requires the hoisting system operations (for example, drilling) to be paused, thus resulting in downtime and increased costs and delays.

A further disadvantage is that energy is wasted for overcoming the moment of inertia and friction in the complete drum, gear and motors, as well as in wires and sheaves. This is particularly the case when operating at lower loads, as is normally the case for a large proportion of the operating time, and for systems with heave compensation capability, in which case the hoisting system will operate continuously to counteract the influence of wave loads on the vessel. Such operation requires significant energy and produces a large number of duty cycles on the hoisting system, requiring more frequent servicing (i.e., cut-and-slip operations).

SUMMARY

An aspect of the present invention is to provide improved hoisting systems to reduce or eliminate the above mentioned disadvantages of known techniques.

In an embodiment, the present invention provides a hoisting system which includes a hoisting tower, a yoke configured to be movable relative to the hoisting tower and to carry a tool, a first winch, a second winch, at least one first sheave arranged in a top section of the hoisting tower, at least one second sheave arranged in the top section of the hoisting tower, at least one first hoisting member arranged to extend from the first winch to the yoke via the at least one first sheave, at least one second hoisting member arranged to extend from the second winch to the yoke via the at least one second sheave, and at least one first releasable connector configured to selectively connect the at least one second hoisting member to the yoke.

BRIEF DESCRIPTION OF THE DRAWINGS

The present invention is described in greater detail below on the basis of embodiments and of the drawings in which.

DETAILED DESCRIPTION

Figure 1:
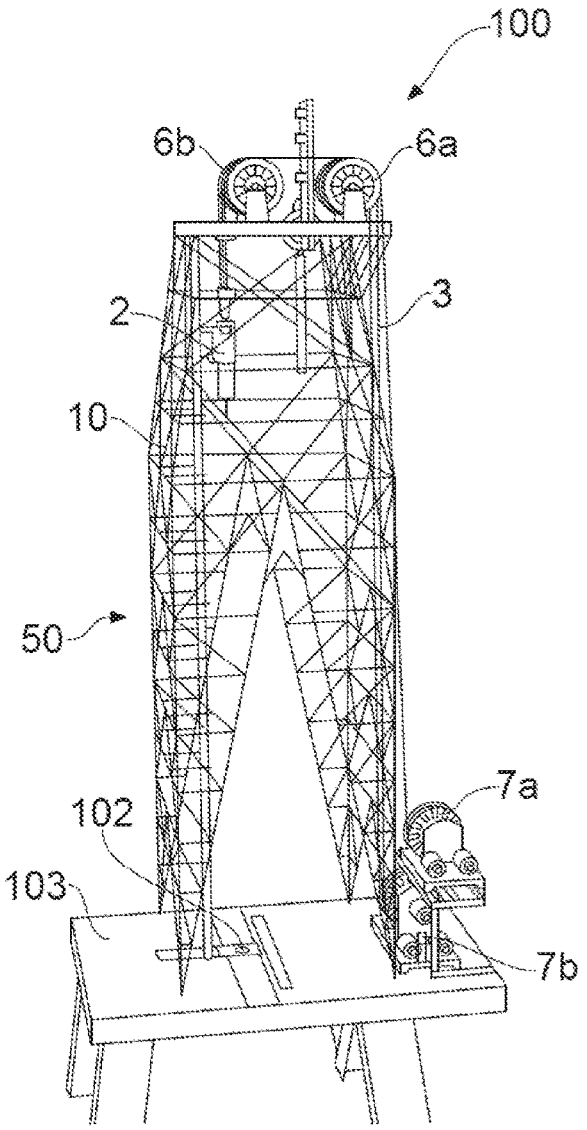
FIG. 1 shows a hoisting system according to the present invention.

In an embodiment, the present invention provides a hoisting system comprising a hoisting tower, a yoke movable relative to the hoisting tower and adapted to carry a tool, at least one first hoisting member extending from a first winch to the yoke via at least one first sheave arranged in a top section of the hoisting tower, at least one second hoisting member extending from a second winch to the yoke via at least one second sheave in the top section of the hoisting tower, and at least one first releasable connector adapted to selectively connect the at least one second hoisting member to the yoke.

In an embodiment, the hoisting system can, for example, further comprise at least one second releasable connector adapted to selectively connect the at least one first hoisting member to the yoke.

In an embodiment of the hoisting system, the tool can, for example, be aligned vertically above a well center.

In an embodiment of the hoisting system, the tool can, for example, be a tool used for at least one of (i) a drilling operation, (ii) a well intervention operation, and (iii) a subsea installation operation.

In an embodiment of the hoisting system, the tool can, for example, be adapted to move relative to the hoisting tower along at least one rail.

In an embodiment of the hoisting system, the first winch can, for example, be provided with heave compensation capability.

In an embodiment of the hoisting system, the second winch can, for example, be provided with heave compensation capability.

In an embodiment, a hoisting system can, for example, comprise a hoisting tower, a yoke movable relative to the hoisting tower and adapted to carry a tool, at least one first elongate hoisting member extending from a first winch to the yoke via at least one first sheave arranged in a top section of the hoisting tower, at least one second hoisting member extending from a second winch to the yoke via at least one second sheave in the top section of the hoisting tower, and a compensator adapted to selectively engage the first elongate hoisting member.

In an embodiment of the hoisting system, the compensator can, for example, be arranged in the top section of the hoisting tower.

In an embodiment of the hoisting system, the first elongate hoisting member can, for example, extend from the first winch to the yoke via at least one third sheave arranged in the top section of the hoisting tower, and the compensator can, for example, be adapted to selectively engage the first elongate hoisting member between the at least one first sheave and the at least one third sheave.

In an embodiment of the hoisting system, the compensator can, for example, be adapted, when engaged, to provide a substantially constant tensioning force on the first elongate hoisting member.

In an embodiment, the hoisting system can, for example, comprise at least one first releasable connector adapted to selectively connect the at least one second hoisting member to the yoke.

In an embodiment, the hoisting system can, for example, comprise at least one second releasable connector adapted to selectively connect the at least one first hoisting member to the yoke.

In an embodiment of the hoisting system, the tool can, for example, be aligned vertically above a well center.

In an embodiment of the hoisting system, the tool can, for example, be a tool used for at least one of (i) a drilling operation, (ii) a well intervention operation, and (iii) a subsea installation operation.

In an embodiment of the hoisting system, the tool can, for example, be adapted to move relative to the hoisting tower along at least one rail.

In an embodiment of the hoisting system, the first winch can, for example, be provided with heave compensation capability.

In an embodiment of the hoisting system, the second winch can, for example, be provided with heave compensation capability.

In an embodiment, the compensator can, for example, comprise a sheave and has a first operating position in which the sheave is spaced from the first elongate hoisting member and a second operating position in which the sheave engages the first elongate hoisting member. The compensator may further comprise at least one hydraulic cylinder operable to control the compensator between the first operating position and the second operating position.

In an embodiment, the hoisting system according to the present invention can, for example, be arranged on a vessel.

Embodiments of the present invention are described below in relation to a drilling rig, however, it is to be understood that the present invention may be suitable for various other applications, including but not limited to well intervention, subsea equipment installation, and other offshore lifting operations.

Figure 2:
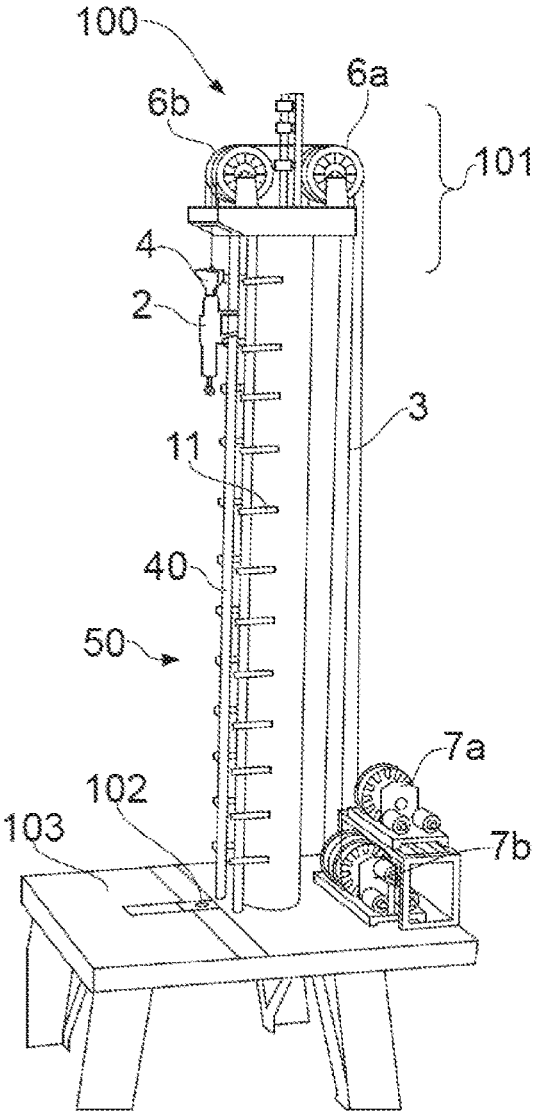
FIG. 2 shows a hoisting system according to the present invention.

Referring to FIGS. 1 and 2, in a first embodiment of the present invention, there is provided a hoisting system 100 for lifting a tool 2 on a drilling rig. The drilling rig may be positioned on a vessel or on a fixed or floating platform. The tool 2 may be a drilling machine, such as a DDM or a top drive, a crown block, an arrangement carrying a tubular (such as a drill string or a riser) or any other tool which is handled during drilling operations. The hoisting system 100 comprises a hoisting tower 50. In the embodiment shown in FIG. 1, the hoisting tower 50 comprises a derrick structure 10, whereas in FIG. 2 it comprises a mast 11. The tool 2 may be positioned above a drill floor 103 and vertically aligned with a well center 102. The tool 2 may be arranged to move vertically along the derrick structure 10 or mast 11 along rails 40 (see FIG. 2) which interact with a support frame 41 (see FIG. 3) on the tool 2.

The tool 2 is lifted by a set of hoisting members 3, such as steel wires. These hoisting members 3 are attached to the tool 2 through a lifting yoke 4 (which is shown in greater detail in FIG. 3). The individual hoisting members 3*a*-3*f* (see FIG. 3) extend over a number of diverter sheaves 6*a*-6*f* (see also FIG. 8), arranged in a top section 101 of the derrick structure 10 or mast 11, to a first winch 7*a* and a second winch 7*b*. Each individual hoisting member 3*a*-3*f* is coupled to either the first winch 7*a* or to the second winch 7*b*. The first winch 7*a* and the second winch 7*b* are illustrated as conventional drawworks, but may be of any type, such as other types of rotating winches or a linear actuator like a hydraulic jigger cylinder or electric linear motor, with any kind of gearing between the actuator and the wire. The hoisting arrangement may also be arranged as a cylinder lifting rig where the hoisting members 3*a*-3*f* are run over diverter sheaves arranged as individual selectable assemblies placed on top of individually selectable ram cylinders.

Figure 3:
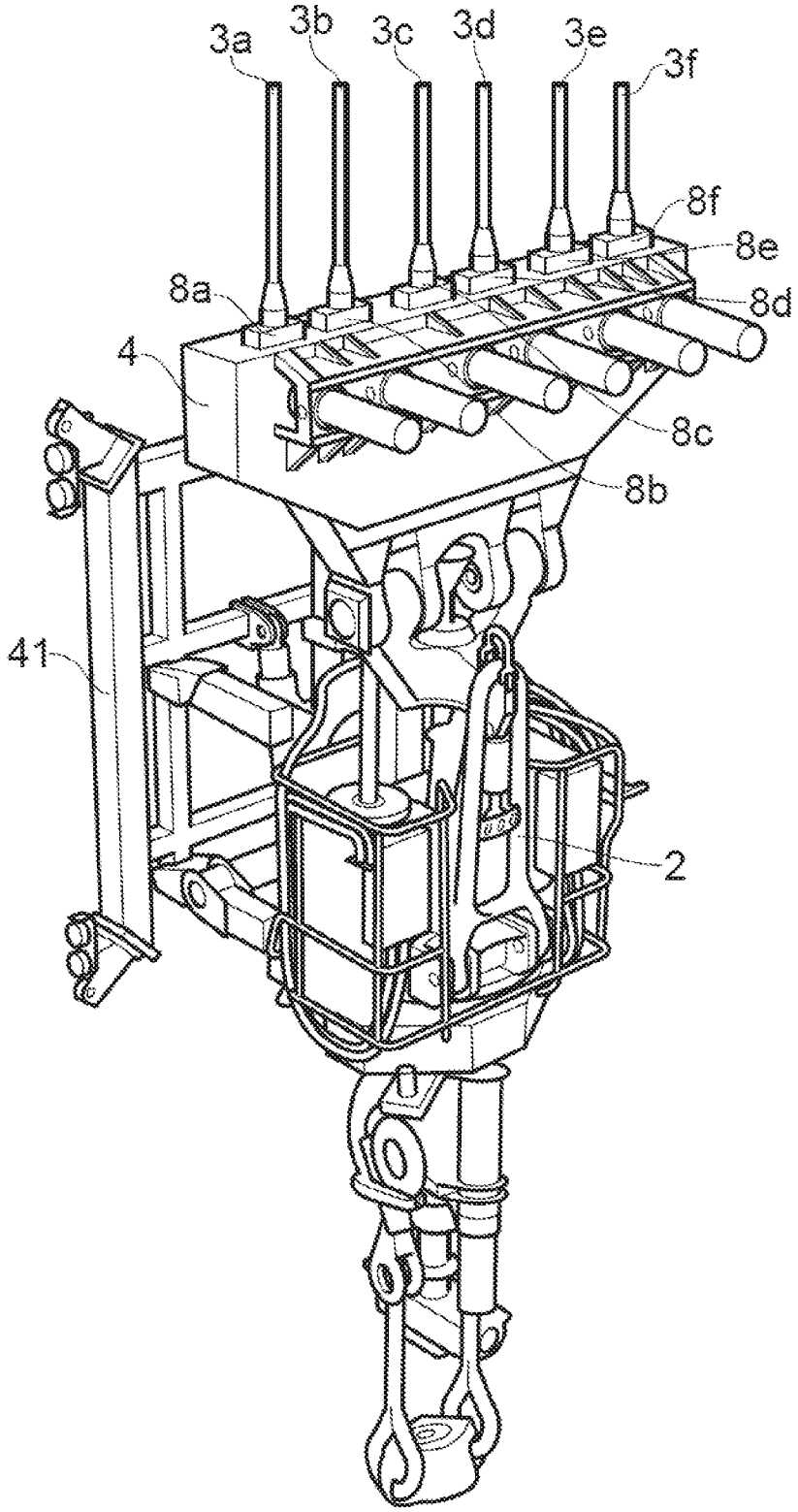
FIG. 3 shows parts of a hoisting system according to the present invention.

FIG. 3 shows the lifting yoke 4 in greater detail. The lifting yoke 4 carries the weight of the tool 2 and any item attached thereto, and is coupled to each individual hoisting member 3*a*-3*f* of the set of hoisting members 3 by connectors 8*a*-8*f*. In this embodiment, the connectors 8*a*-8*f* allow any number of the individual hoisting members 3*a*-3*f* to be selectively connected to or disconnected from the lifting yoke 4 for any given operation. Alternatively, only a subset of the connectors 8*a*-8*f* may be made releasable while some may be permanently attached to the lifting yoke 4. For example, in an alternative embodiment, connectors 8*c* and 8*d* may be permanently attached to the lifting yoke 4 while connectors 8*a*, 8*b*, 8*e* and 8*f* are arranged as releasable connectors.

The connectors 8*a*-8*f* may be manually operated or be made remotely controlled and engaged/disengaged by use of pneumatic, hydraulic or electrical actuators. The lifting yoke 4 attach/detach mechanism can be made with actuator dogs inserted in connector slots aligned with slots in the lifting yoke 4. The hoisting system 100 may use feedback instrumentation for verification of successful attach/detach sequences.

Figure 4:
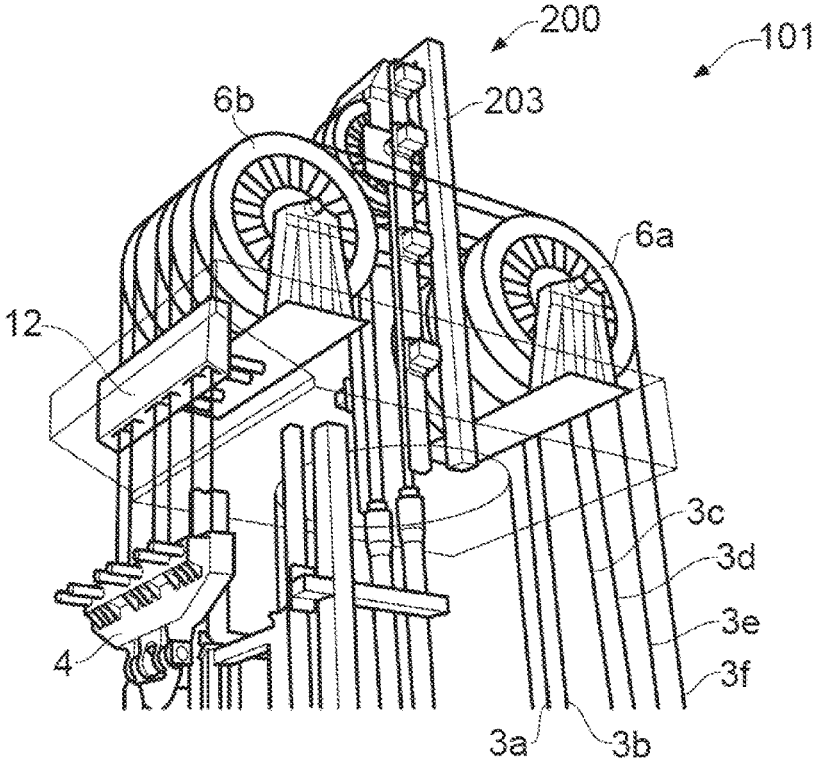
FIG. 4 shows a first top section of a hoisting system according to the present invention.
Figure 5:
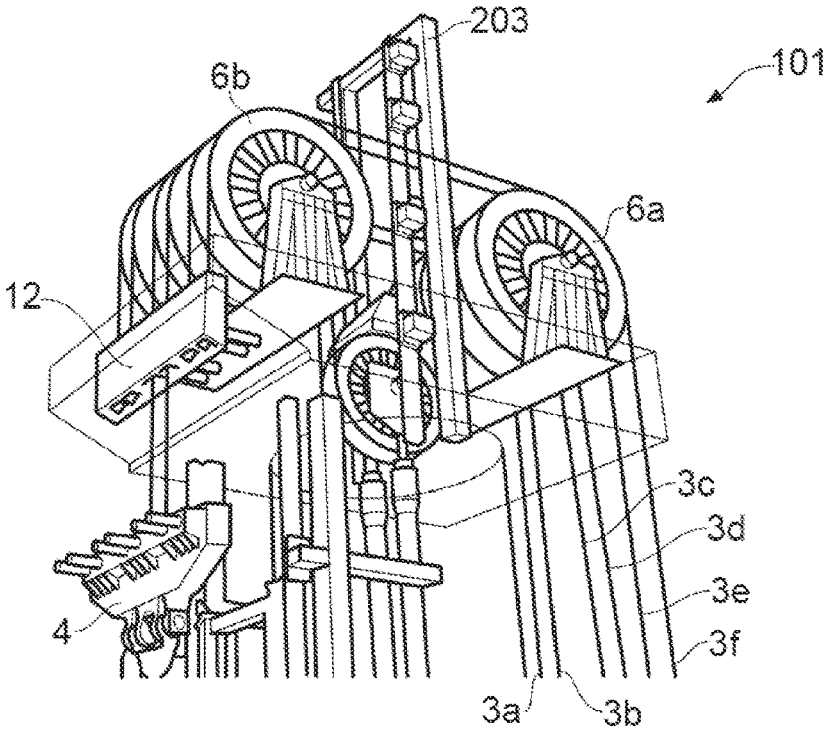
FIG. 5 shows a second top section of a hoisting system according to the present invention.

FIGS. 4 and 5 illustrate a top section 101 of the hoisting system 100 in further detail. In FIG. 4 all six hoisting members 3*a*-3*f* are connected to the lifting yoke 4. The hoisting members 3*a*, 3*b*, 3*e* and 3*f* are connected to the second winch 7*b*, while hoisting members 3*c* and 3*d* are connected to the first winch 7*a* (see FIGS. 1 and 2). This provides full lifting capacity of the hoisting system 100, both the first winch 7*a* and the second winch 7*b* thus provide lifting of the tool 2.

FIG. 5 shows an alternative operational arrangement, wherein only hoisting members 3*c* and 3*d* are connected to the lifting yoke 4, whereas the other hoisting members are in a retracted position in a connector docking unit 12. In this case only the first winch 7*a* is operational, while the second winch 7*b* is in a stand-by position.

The number of hoisting members 3*a*-3*f* connected to the lifting yoke 4 and the capacities of the first winch 7*a* and the second winch 7*b* operating the hoisting members decide the full lifting capacity of the hoisting system 100.

Advantageously, this configuration allows the hoisting system 100 to be adapted to any given operational requirement. For example, when maximum lifting capacity is required, all hoisting members 3*a*-3*f* can be engaged, whereas when a reduced load is present the hoisting system 100 can be operated selectively by the first winch 7*a* with two hoisting members 3*c* and 3*d*, or by the second winch 7*b* with four hoisting members 3*a*, 3*b*, 3*e*, 3*f*. This provides a number of advantages, including reduced wear in the hoisting system 100 since the individual hoisting lines will be subjected to fewer load cycles. Decoupling one winch also allows replacement of the hoisting member (for example, steel wire cut-and-slip) on that winch while the hoisting system 100 remains operational with the other winch. By advance planning of such wire replacements, downtime of the hoisting system 100 can thus be significantly reduced or even eliminated.

In an embodiment of the hoisting system 100, at least one of the first winch 7*a* or the second winch 7*b* is provided with active heave compensation capability. Use of drawworks or winches for heave compensation is known in the art of offshore hoisting systems, and will therefore not be described further. A challenge with heave compensation, in particular in high-capacity hoisting systems, is friction and acceleration lag when large masses (winch drum, lifting wire, sheaves, etc.) need to be accelerated rapidly. By providing at least one of the winches with heave compensation capability, one can achieve improved compensation performance, in particular for low loads.

For example, in the case of an installation on the seafloor, for example, of a wellhead component, very accurate heave compensation may be required, however, this operation may not require the full lifting capacity of the hoisting system 100. Utilizing, for example, the first winch 7*a* with heave compensation capability for such an operation, with the second winch 7*b* in stand-by position, the hoisting system 100 according to the present invention provides significantly improved compensation performance.

In an embodiment, both the first winch 7*a* and the second winch 7*b* can, for example, be provided with active heave compensation capability. This provides operational flexibility and allows, for example, servicing or maintenance of one winch while the other, and thus the hoisting system, remains fully operational. Heave compensation capability would be available at any time in such a case.

Referring now in particular to FIGS. 6-9, a further aspect of the present invention provides a hoisting system 100 comprising a compensator 200 arranged to selectively engage at least one of the hoisting members 3*a*-3*f*. In the embodiment shown, the compensator 200 engages hoisting members 3*c* and 3*d*. The compensator 200 thus cooperates with the first winch 7*a* when engaged. The compensator 200 comprises a sheave 201 which is vertically movable along a frame 203. The sheave 201 engages the hoisting members 3*c* and 3*d* between the sheaves 6*c* and 6*d* (see FIGS. 8 and 9). Hydraulic cylinders 202*a* and 202*b* control the position of the sheave 201.

Figure 6:
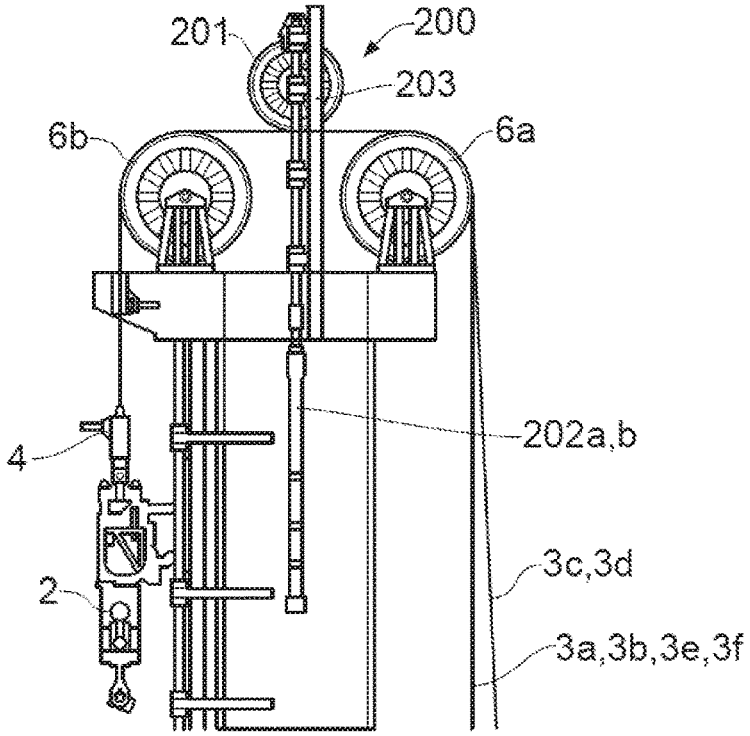
FIG. 6 shows a first different view of a top section as shown in FIGS. 4 and 5.
Figure 8:
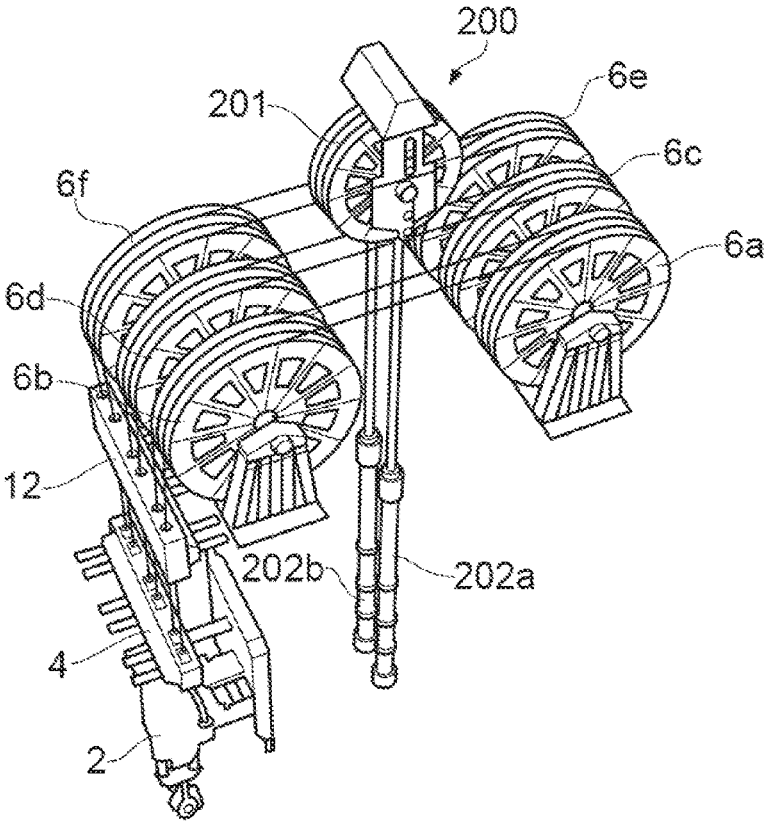
FIG. 8 show parts of a hoisting system according to the present invention.

In a first position, shown in FIGS. 4, 6 and 8, the hydraulic cylinders 202*a* and 202*b* are fully extended and the sheave 201 is positioned away from the hoisting members 3*c* and 3*d*, and does not come into contact therewith. The hoisting system 100 can thus be operated without influence of the compensator 200 so that the compensator 200 does not produce any friction or wear in this position.

Figure 7:
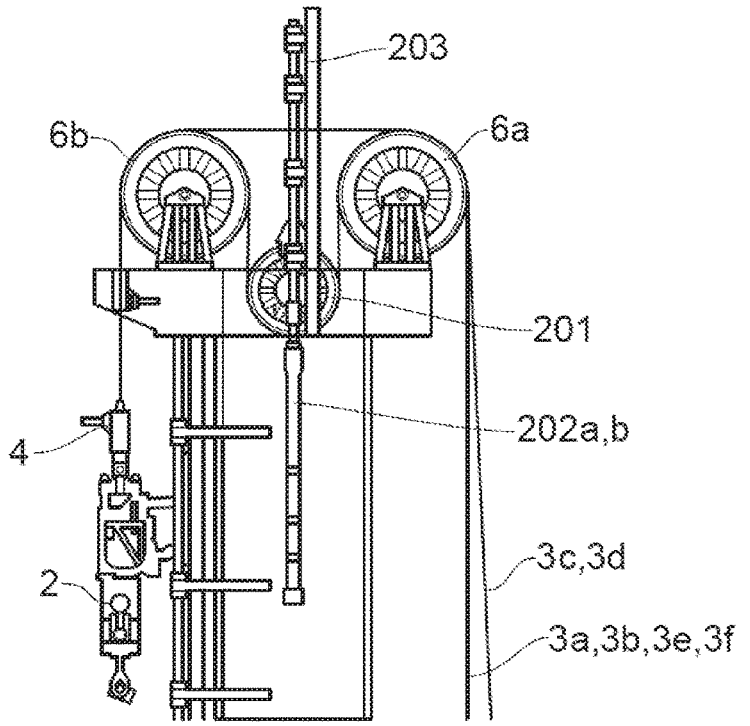
FIG. 7 shows a second different view of a top section as shown in FIGS. 4 and 5.
Figure 9:
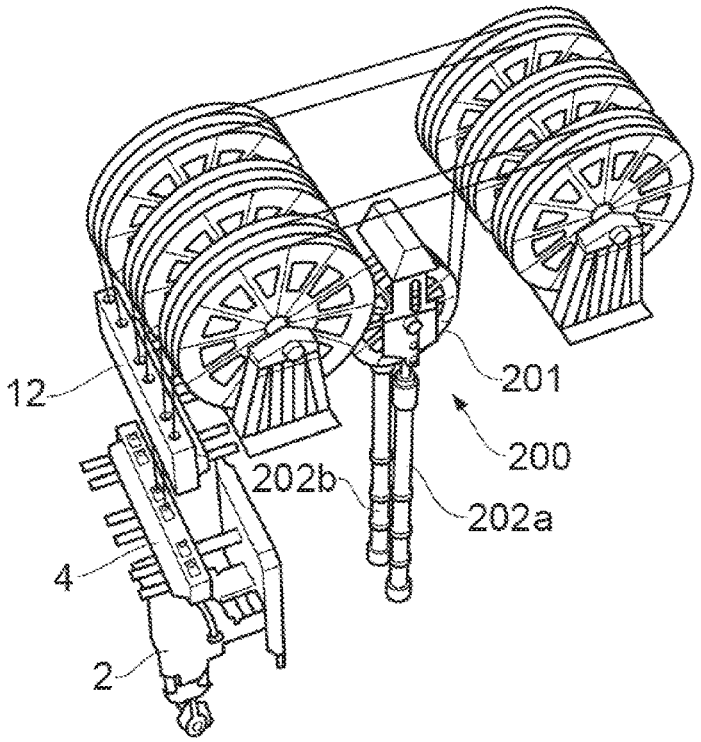
FIG. 9 shows parts of a hoisting system according to the present invention.

In a second position, shown in FIGS. 5, 7 and 9, the hydraulic cylinders 202*a* and 202*b* provide tension on the sheave 201, which again engages the hoisting members 3*c* and 3*d*. The compensator 200 can thus provide passive heave compensation on the hoisting members 3*c* and 3*d* by controlling the hydraulic cylinders 202*a* and 202*b* to produce a substantially constant tension force.

The connectors 8*a*, 8*b*, 8*e* and 8*f* are arranged to be releasable in the shown embodiment, as is described above. This allows the second winch 7*b* to be disconnected from the lifting yoke 4. In an embodiment, the first winch 7*a* can, for example, be provided with heave compensation capability. This allows the first winch 7*a* and the associated hoisting members 3*c* and 3*d* to provide hoisting capability with passive and/or active heave compensation, while the second winch 7*b* can be held in a standby position or undergo service or maintenance.

Alternatively, the connectors 8*a*-8*f* may be fixed to the lifting yoke 4 (i.e., not releasable, or releasable but maintained in a connected state). The first winch 7*a* in this case may still provide the full required lifting and compensation functionality, while the second winch 7*b* may be operated to provide only a small force to its associated hoisting members 3*a*, 3*b*, 3*e* and 3*f* in order to maintain a minimum tension therein. The second winch 7*b* would then effectively run idle.

In another alternative, the connectors 8*a*-8*f* are fixed to the lifting yoke 4, while the compensator 200 provides passive heave compensation and the second winch 7*b* provides active heave compensation. In this case, the first winch 7*a* may be maintained in a standstill position, for example, by engaging the drum brakes. This provides the opportunity to carry out servicing or maintenance on components of the first winch 7*a*, while keeping the hoisting system 100 operational both with hoisting capability, passive and active heave compensation.

By the operational flexibility achieved with a hoisting system 100 according to the present invention, it is possible to design the hoisting system 100 with different characteristics and capabilities for the different components, for example, arranging the first winch 7*a* and the second winch 7*b* with a different hoisting capacity and dynamic response characteristics. This allows further operational optimization and improves energy efficiency and performance.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing the present invention in diverse forms thereof.

The present invention is not limited to the embodiments descried herein. Reference should be had to the appended claims.

What is claimed is:

1. A hoisting system comprising:

a hoisting tower;

a yoke configured to be movable relative to the hoisting tower and to carry a tool being hung from the yoke;

a first winch;

a second winch;

at least one first sheave arranged in a top section of the hoisting tower;

at least one second sheave arranged in the top section of the hoisting tower;

a plurality of hoisting members, each of the plurality of hoisting members being coupled to either the first winch or to the second winch, the plurality of hoisting members comprising at least one first hoisting member which is arranged to extend from the first winch to the yoke via the at least one first sheave;

at least one second hoisting member arranged to extend from the second winch to the yoke via the at least one second sheave; and at least one first releasable connector configured to selectively connect the at least one second hoisting member to the yoke.

2. The hoisting system as recited in claim 1, further comprising:

at least one second releasable connector configured to selectively connect the at least one first hoisting member to the yoke.

3. The hoisting system as recited in claim 1, wherein the tool is aligned vertically above a well center.

4. The hoisting system as recited in claim 3, wherein the tool is configured to be used for at least one of a drilling operation, a well intervention operation, and a subsea installation operation.

5. The hoisting system as recited in claim 1, wherein the first winch is provided with a heave compensation capability.

6. The hoisting system as recited in claim 5, wherein the second winch is provided with the heave compensation capability.

7. The hoisting system as recited in claim 1, wherein the hoisting system is arranged on a vessel.

8. A hoisting system comprising:

a hoisting tower;

a yoke configured to be movable relative to the hoisting tower and to carry a tool;

a first winch;

a second winch;

at least one first sheave arranged in a top section of the hoisting tower;

at least one second sheave arranged in the top section of the hoisting tower;

at least one first elongate hoisting member arranged to extend from the first winch to the yoke via the at least one first sheave;

at least one second hoisting member arranged to extend from the second winch to the yoke via the at least one second sheave;

a compensator configured to selectively engage the at least one first elongate hoisting member, the compensator comprising a sheave which is configured to be vertically movable along a frame; and at least one third sheave arranged in the top section of the hoisting tower, wherein, the at least one first elongate hoisting member is further arranged to extend from the first winch to the yoke via the at least one third sheave, the compensator comprises a first operating position in which the sheave is spaced from the at least one first elongate hoisting member and a second operating position in which the sheave engages the at least one first elongate hoisting member, and the compensator is further configured to selectively engage the at least one first elongate hoisting member between the at least one first sheave and the at least one third sheave.

9. The hoisting system as recited in claim 8, wherein the compensator is arranged in the top section of the hoisting tower.

10. The hoisting system as recited in claim 8, wherein the compensator is further configured, when engaged, to provide a substantially constant tensioning force on the at least one first elongate hoisting member.

11. The hoisting system as recited in claim 8, further comprising:

at least one first releasable connector configured to selectively connect the at least one second hoisting member to the yoke.

12. The hoisting system as recited in claim 11, further comprising:

at least one second releasable connector configured to selectively connect the at least one first hoisting member to the yoke.

13. The hoisting system as recited in claim 8, wherein the tool is aligned vertically above a well center.

14. The hoisting system as recited in claim 13, wherein the tool is configured to be used for at least one of a drilling operation, a well intervention operation, and a subsea installation operation.

15. The hoisting system as recited in claim 8, wherein the first winch is provided with a heave compensation capability.

16. The hoisting system as recited in claim 15, wherein the second winch is provided with the heave compensation capability.

17. The hoisting system as recited in claim 8, wherein the compensator further comprises at least one hydraulic cylinder which is configured to control the compensator between the first operating position and the second operating position.

18. The hoisting system as recited in claim 8, wherein the hoisting system is arranged on a vessel.

19. A hoisting system comprising:

a hoisting tower;

a yoke configured to be movable relative to the hoisting tower and to carry a tool being hung from the yoke;

a first winch;

a second winch;

a plurality of sheaves arranged in a top section of the hoisting tower;

a first set of hoisting members arranged to extend from the first winch to the yoke via the plurality of sheaves;

a second set of hoisting members arranged to extend from the second winch to the yoke via the plurality of sheaves; and a first plurality of releasable connectors arranged on the first set of hoisting members, the first plurality of releasable connectors being configured to selectively connect the first set of hoisting members to the yoke.

20. The hoisting system as recited in claim 19, further comprising:

a second plurality of releasable connectors arranged on the second set of hoisting members, the second plurality of releasable connectors being configured to selectively connect the second set of hoisting members to the yoke.

21. A hoisting system comprising:

a hoisting tower;

a yoke configured to be movable relative to the hoisting tower and to carry a tool being hung from the yoke;

a first winch;

a second winch;

a plurality of sheaves arranged in a top section of the hoisting tower;

a first set of hoisting members, each hoisting member in the first set of hoisting members being arranged to extend from the first winch to the yoke via the plurality of sheaves and being fixed to the yoke via a connector;

a second set of hoisting members, each hoisting member in the second set of hoisting members being arranged to extend from the second winch to the yoke via the plurality of sheaves and being fixed to the yoke via a connector.

22. The hoisting system as recited in claim 21, wherein each of the connectors which fix the first set of hoisting members to the yoke is a releasable connector which is configured to selectively connect the first set of hoisting members to the yoke.

23. The hoisting system as recited in claim 21, wherein each of the connectors which fix the second set of hoisting members to the yoke is a releasable connector which is configured to selectively connect the second set of hoisting members to the yoke.

* * * * *